US009957756B2

(12) United States Patent
Shiwei

(10) Patent No.: US 9,957,756 B2
(45) Date of Patent: May 1, 2018

(54) ROLLER CONE DRILL BIT ASSEMBLY WITH VARYING RADIUS BEARING SURFACES

(71) Applicant: HALLIBURTON ENERGY SERVICES, INC., Houston, TX (US)

(72) Inventor: Qin Shiwei, Conroe, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 76 days.

(21) Appl. No.: 15/034,805

(22) PCT Filed: Jul. 2, 2015

(86) PCT No.: PCT/US2015/039081
§ 371 (c)(1),
(2) Date: May 5, 2016

(87) PCT Pub. No.: WO2017/003486
PCT Pub. Date: Jan. 5, 2017

(65) Prior Publication Data

US 2017/0159364 A1 Jun. 8, 2017

(51) Int. Cl.
*E21B 10/22* (2006.01)
*E21B 17/00* (2006.01)

(52) U.S. Cl.
CPC ..... *E21B 10/22* (2013.01); *E21B 17/00* (2013.01)

(58) Field of Classification Search
CPC ..... E21B 10/22–10/25
See application file for complete search history.

(56) References Cited

U.S. PATENT DOCUMENTS

| | | | | |
|---|---|---|---|---|
| 3,361,494 | A | 1/1968 | Galle | |
| 4,010,985 | A * | 3/1977 | Rear | E21B 10/22 384/92 |
| 4,625,816 | A | 12/1986 | Takano | |
| 4,899,838 | A | 2/1990 | Sullivan et al. | |
| 6,474,424 | B1 | 11/2002 | Saxman | |
| 6,533,051 | B1 | 3/2003 | Singh et al. | |
| 7,360,612 | B2 | 4/2008 | Chen et al. | |
| 7,387,177 | B2 | 6/2008 | Zahradnik et al. | |

(Continued)

FOREIGN PATENT DOCUMENTS

| | | | | |
|---|---|---|---|---|
| SU | 972035 | A * | 11/1982 | E21B 10/22 |
| WO | 2011031636 | A2 | 3/2011 | |

OTHER PUBLICATIONS

Petrowiki; Roller Cone Bit Components, Jun. 26, 2015, http://petrowiki.org/Roller_cone_bit_components.

(Continued)

*Primary Examiner* — D. Andrews
*Assistant Examiner* — Dany E Akakpo
(74) *Attorney, Agent, or Firm* — Polsinelli PC

(57) ABSTRACT

A roller cone drill bit assembly with a bearing shaft having an outer bearing surface and defining a rotational axis. The outer bearing surface includes a necked portion having a varying radius with respect to the rotational axis. A roller cone is coupled about the bearing shaft and includes an outer cutting structure and an inner bearing surface. The inner bearing surface includes a necked portion proximate to and closely conforming to the necked portion of the outer bearing surface.

19 Claims, 7 Drawing Sheets

(56) References Cited

U.S. PATENT DOCUMENTS

| | | | | |
|---|---|---|---|---|
| 2004/0000435 | A1* | 1/2004 | Nguyen | E21B 10/25 175/372 |
| 2009/0194339 | A1* | 8/2009 | Dick | E21B 10/22 175/371 |
| 2013/0140093 | A1 | 6/2013 | Zhou et al. | |
| 2014/0182937 | A1 | 7/2014 | Slaughter, Jr. et al. | |

OTHER PUBLICATIONS

International Search Report and Written Opinion dated Mar. 31, 2016 in International Application No. PCT/US2015/039081.

* cited by examiner

ROLLER CONE DRILL BIT ASSEMBLY WITH VARYING RADIUS BEARING SURFACES

CROSS-REFERENCE TO RELATED APPLICATIONS

This application is a national stage entry of PCT/US2015/039081 filed Jul. 2, 2015, said application is expressly incorporated herein in its entirety.

FIELD

The present disclosure relates generally to bearing designs in roller cone drill bit assemblies.

BACKGROUND

In the oil and gas industry, various drill bits have been used for the drilling of well bores in downhole formations. One type of drill bit is a roller cone drill bit, which frequently includes a body with two or more support arms extending therefrom. Roller cones are provided on the arms which rotate each on its own axis during drilling. The roller cones are provided with a cutting structure for drilling through various formations.

Drill bits often have arrangements where the force applied to the cutting surfaces of the drill bits is at an angle to the bearing axis. For example, in the roller cone drill bit, the rotating cones of the bit are angled towards the center placing their rotational axis at an angle to orientation of the well bore. This makes one part of the cutting surface of the rotary cone a "lead" edge, meaning it is doing the primary cutting, while the rest is not.

BRIEF DESCRIPTION OF THE DRAWINGS

Implementations of the present technology will now be described, by way of example only, with reference to the attached figures, wherein.

Figure 1A:
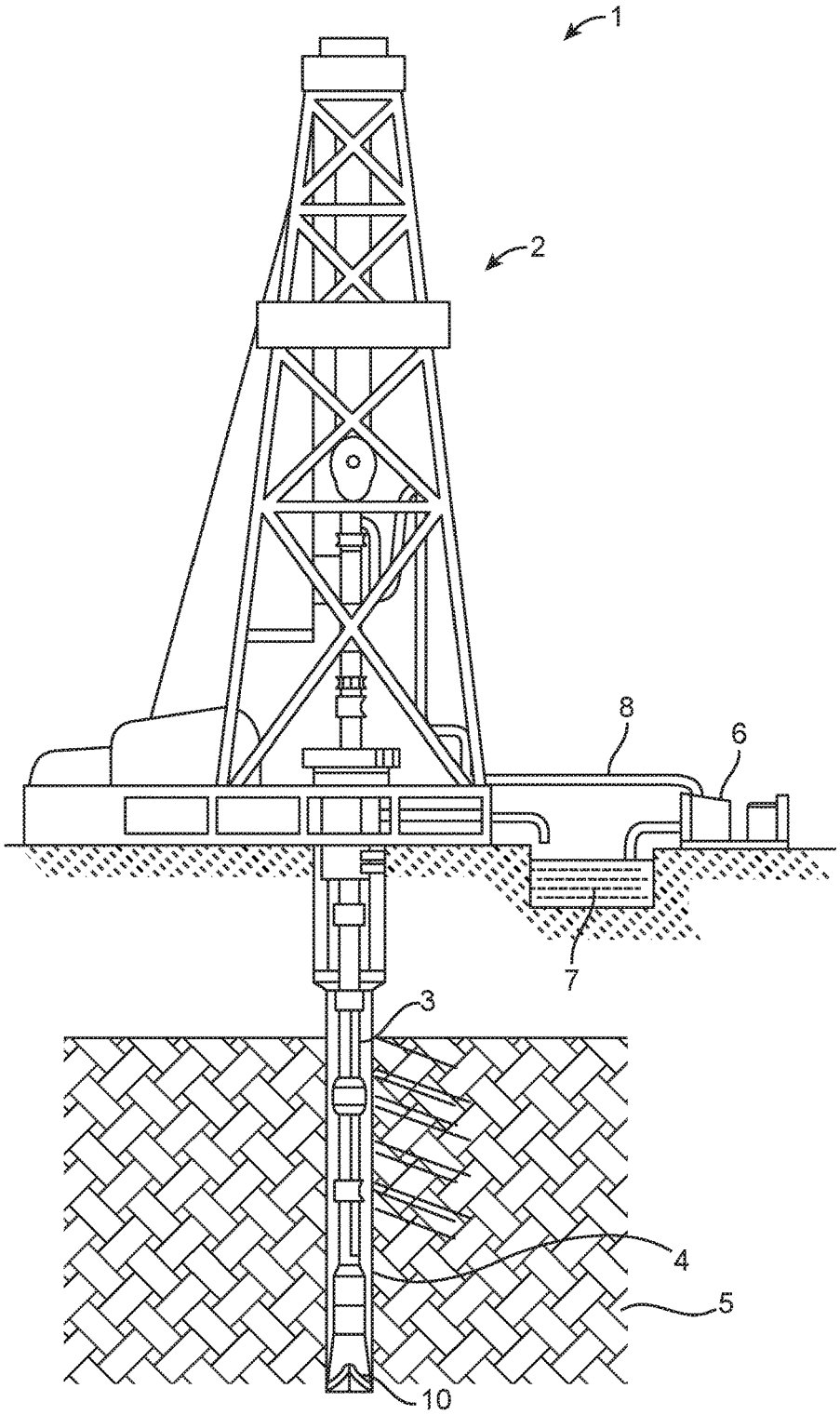
FIG. 1A is a diagram illustrating an example drill system.

It should be understood that the various embodiments are not limited to the arrangements and instrumentality shown in the drawings.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Disclosed herein is a roller cone drill bit assembly having a roller cone rotationally disposed on a bearing shaft, where the bearing surfaces between the roller cone and bearing shaft have a portion with a varying radius with respect to the rotational axis of the roller cone. While drilling, the lead edge of a roller cone can experience significant forces as the roller cone is urged against the formation being drilled. As a result of the orientation of the rotational axis with respect the direction of the cone, a similar force can be correspondingly transmitted to the bearing surfaces within the cone. The varying radius of the inner and outer surfaces as disclosed herein can assist in spreading the force over a larger area of the bearing surfaces and thereby reduce the uneven wear which may otherwise occur.

While the disclosure described is with respect to roller cone drill bit assemblies, one of ordinary skill in the art will recognize that the techniques disclosed may be easily adaptable to other rotational assemblies.

An exemplary environment in which the roller cone drill bit assembly disclosed herein can be employed includes drill system 1 as illustrated in FIG. 1A. Drill system 1 may include a drilling rig 2 and a drill string 3. A drill bit 10 can be provided at the lower end of the drill string 3, which can for example be a roller cone drill bit assembly as disclosed herein. The drill bit 10 is rotated to create wellbore 4 in formation 5. A pump 6 circulates drilling fluid to a supply pipe 8 which can then be transmitted downhole through an interior of the drill string 3. The drill bit 10 is just one component of a bottom-hole assembly that typically includes one or more drill collars to provide weight and rigidity to aid the drilling process. Some of these drill collars include logging instruments to gather measurements of various drilling parameters such as position, orientation, weight-on-bit, borehole diameter, etc.

Figure 1B:
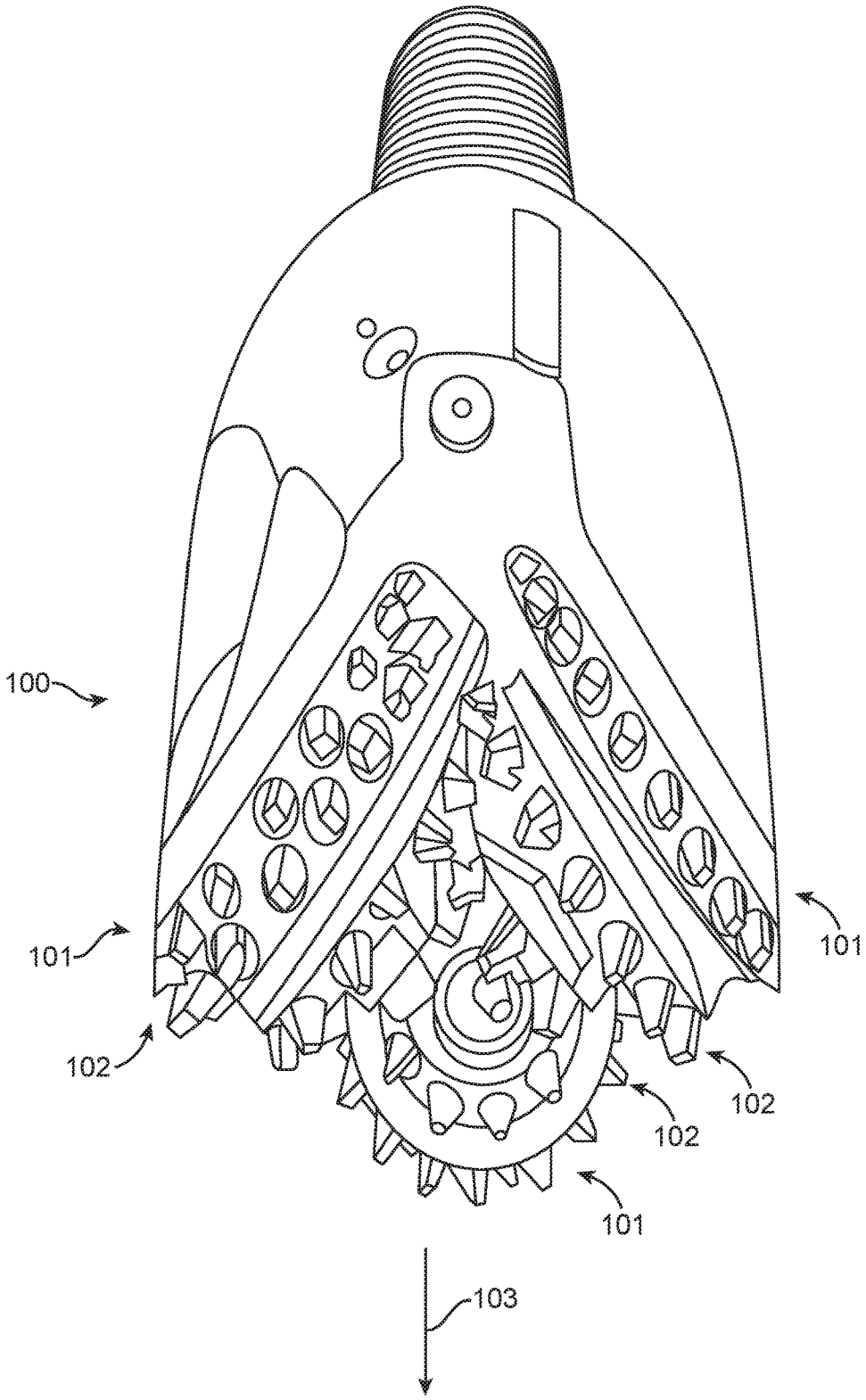
FIG. 1B is a diagram illustrating an example of a roller cone drill bit.

The drill systems such as those depicted in FIG. 1A often use roller cone drill bits, such as the bit 100 depicted in FIG. 1B, which are typically comprised of multiple, individual roller cones 101. As shown in the illustrated embodiment, there are three roller cones 101. One of ordinary skill in the art will recognize that more or less number of cones can be employed. The roller cones 101 have an outer cutting structure generally indicated at 102 designed for cutting. The cutting structure 102 can include a plurality of cutting elements, which may be arrange in rows on the surface of roller cone 101. The cutting elements may be made up of tungsten, carbine inserts, polycrystalline diamond compacts, and/or milled steel teeth, or other suitable material known in the art. When drilling, the drill bit 100 is axially advanced in direction 103 as it progressively drills a borehole.

Figure 2:
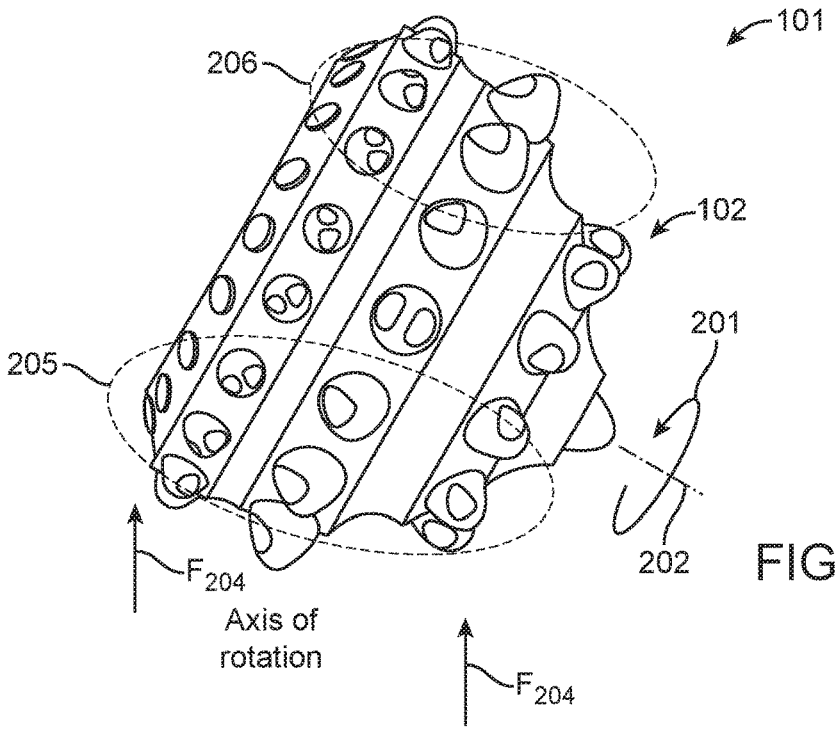
FIG. 2 is a diagram illustrating a roller cone.

One of the cones 101 of drill bit 100 is depicted in FIG. 2. As shown, roller cone 101 rotates about a rotational axis 202, with an example rotational direction illustrated at 201. As the bit 100 (FIG. 1B) is urged against the lower end of a wellbore, the roller cone 101 contacts and cuts into the formation. However, the force of contact exerted on the cone 101 is experienced unevenly about the circumference of the cutting structure 102 of the cone 101. In particular, force is applied on one side of the cutting structure 102, and in a direction oblique to the rotational axis 202 (the rotational axis 202 forming an angle with the force applied in the direction of arrows F204). In particular, the force resulting from contact with the formation being cut is experienced at section 205 of the cutting structure 102 of roller cone 101 and in the direction of arrows F204. Consequently, roller cone 101 experiences significant force in the direction of the arrows F204. Internally, this causes greater force to be experienced at a particular portion of the bearing surfaces within the roller cone 101, which is alleviated as further described below.

Figure 3:
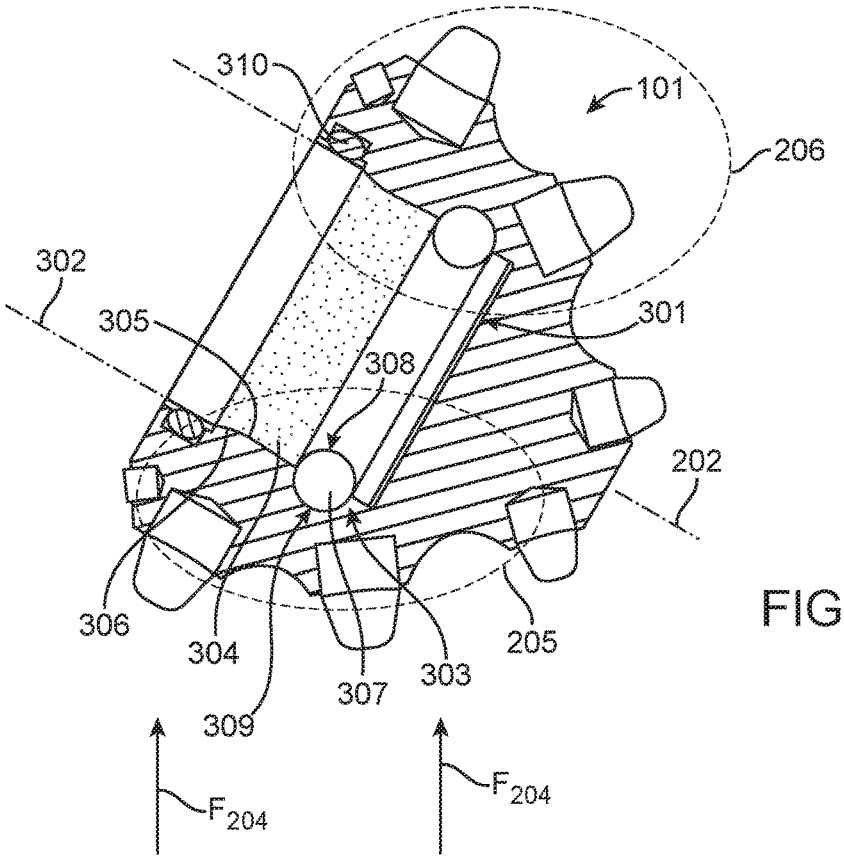
FIG. 3 is a diagram illustrating a cross sectional view of a roller cone.

The interior of roller cone 101 has a cavity 301, as depicted in FIG. 3. Cavity 301 is substantially cylindrical in shape, and adapted to receive shaft 302. Shaft 302 is connected at a thrust surface to the cavity 301 within roller cone 101. The shaft 302 has an outer bearing surface 306, and the roller cone 101 has an inner bearing surface 305. The outer bearing surface 306 of the shaft 302 and the inner bearing surface 305 of the roller cone 101 cooperate to form a journal bearing 304. Accordingly, shaft 302 can also be referred to herein as a bearing shaft. A retention mechanism 303 is used to help keep the roller cone attached to the shaft 302 at one end of journal bearing 304. The retention mechanism 303 can include a portion having, for example, roller balls 307 and ball races 308 and 309. Seal 310 is provided at the other end of journal bearing 304, and is used to keep lubrication (not shown) from escaping the journal bearing.

One of ordinary skill in the art will recognize that the journal bearing, ball bearings, seal, and other aspects that are depicted and described are only examples of the types and designs of bearings that could be used. Any bearing form and retention mechanism capable of keeping roller cone 101 sufficiently rotatable around and attached to shaft 302 may be used. For example, while no sleeve is depicted, journal bearings using sleeves or other features can also be used. Further, the bearing need not be a journal bearing, as other bearing types, such as a bushing, rifle bearing, roller bearing, or other bearing having substantially parallel surfaces in some aspect could be used.

When experiencing force in the direction of arrows F204 at section 205 of roller cone 101 as described in connection with FIG. 2, this force is correspondingly transmitted to the surfaces of the journal bearing 304 along surfaces 305 and 306. When exposed to this directional force, the orientation of the journal bearing (the rotational axis 202 being at an angle to the force in the direction of arrows F204) causes a portion of surface 305 to bear against a portion of surface 306 with a greater force closer toward the seal 310. As a result, a smaller portion of the bearing surface bears a greater proportion of the force F204, resulting in greater wear and potential failure. As further discussed in FIGS. 4A-4C below, the radius of the bearing surfaces with respect to the rotational axis can be varied in order to spread the force F204 over a larger area of the bearing surfaces 305 and 306.

Figure 4A:
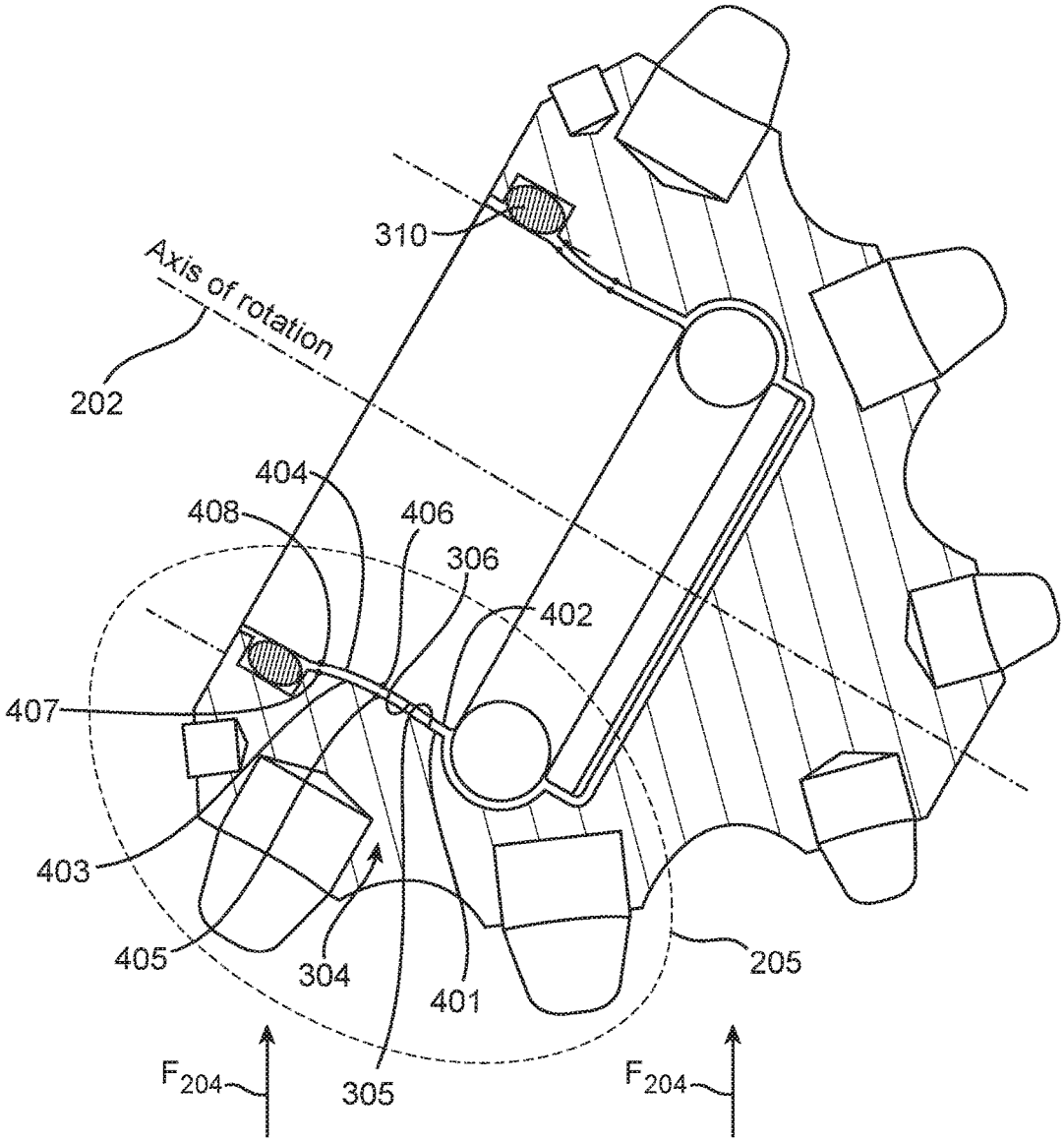
FIG. 4A is a diagram illustrating a cross sectional view of a roller cone.
Figure 4B:
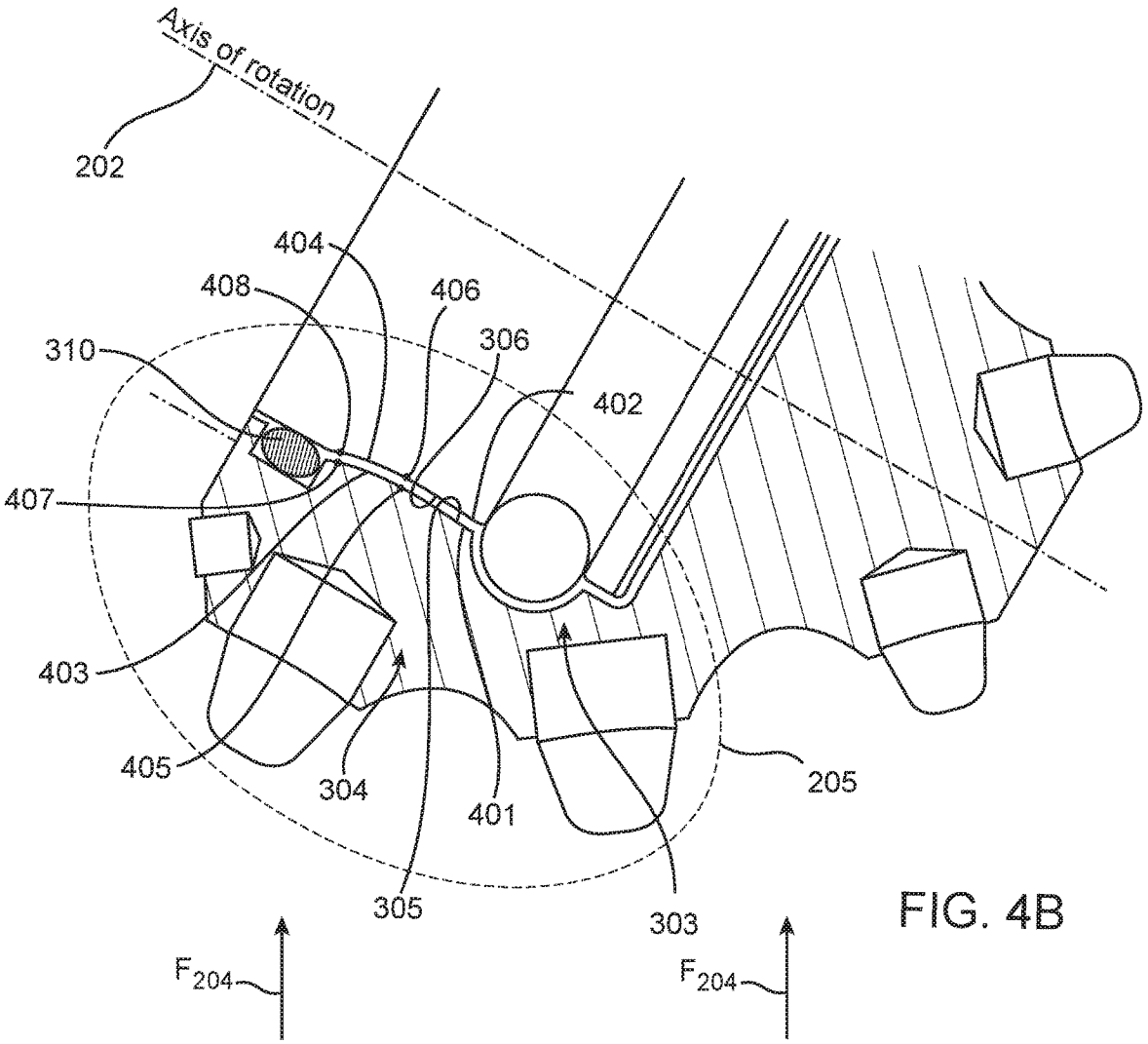
FIG. 4B is close up view of one section of the diagram shown in FIG. 4A.
Figure 4C:
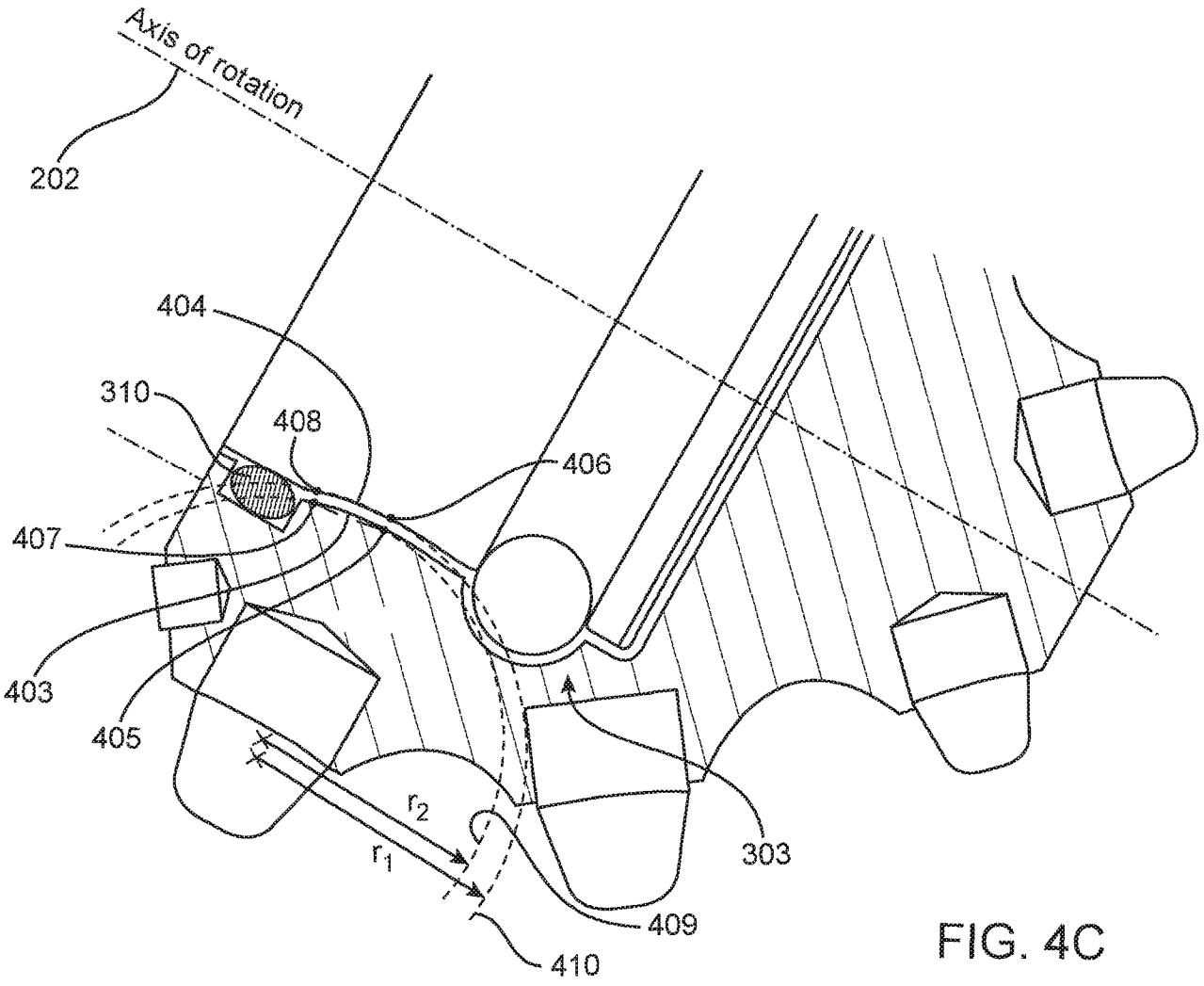
FIG. 4C is close up view of one section of the diagram shown in FIG. 4A.

FIG. 4A illustrates a cross section of journal bearing 304 in the plane through the rotational axis, and FIG. 4B illustrates a close up view of section 205 of the roller cone 101. As shown in FIGS. 4A and 4B, outer bearing surface 306 of the shaft 302 lies substantially adjacent to inner bearing surface 305 of the roller cone 101. The outer bearing surface 306 of the shaft 302 has a necked portion 404 positioned between point 406, which is approximately midway between the seal 310 and retention mechanism 303, and a point 408 which is at or near the seal 310. Correspondingly, the inner bearing surface 305 of the roller cone 101 has a necked portion 403 proximate to and closely conforming to the necked portion 404 of the outer bearing surface 306. The necked portion 403 of the inner bearing surface 305 is positioned between point 405, which is approximately midway between the seal 310 and retention mechanism 303, and a point 407 which is at or near the seal 310.

The necked portion 404 of the outer bearing surface 306 of the shaft 302 has a varying radius with respect to the rotational axis 202. For example, the necked portion 404 can have an increasing radius as the necked portion 404 approaches the seal 310 (making the necked portion 404 have a concave shape with respect to the shaft 302). As the necked portion 403 of the inner bearing surface 305 of the roller cone 101 closely conforms to the necked portion 404 of the outer bearing surface 306, it will also have a varying radius, for example, the necked portion 403 can have an increasing radius as the necked portion 403 approaches the seal 310 (making the necked portion 403 have a convex shape with respect to the roller cone 301).

Moreover, the necked portion 404 of the outer bearing surface 306 and the necked portion 403 of the inner bearing surface 305 can differ in the degree to which their respective radius varies. For example, referring to FIG. 4C, which illustrates a close up of the cross section shown in FIG. 4A in the area of section 205, the necked portion 404 of the outer bearing surface 306 (FIG. 4A) can have a first radius of curvature (r1) in a plane through the rotational axis 202 (radius of circle 410). Additionally, the necked portion 403 of the inner bearing surface 305 (FIG. 4A) can also have a second radius of curvature (r2) through the rotational axis 202 (radius of circle 409). The first radius of curvature (r1) of the necked portion 404 can differ from the second radius of curvature (r2) of the necked portion 403.

The first radius of curvature (r1) can differ from the second radius of curvature (r2) by between 2% and 15%. Additionally, the first radius of curvature (r1) can be larger than the second radius of curvature (r2). In particular, the first radius of curvature (r1) can be larger than the second radius of curvature (r2) by between 2% and 15%. Due to this difference in radius, the surface area for contact between surfaces 305 and 306 is increased, thus spreading the experienced forces and alleviating pressure between the bearing surfaces thereby reducing wear and/or the potential for failure.

Figure 4D:
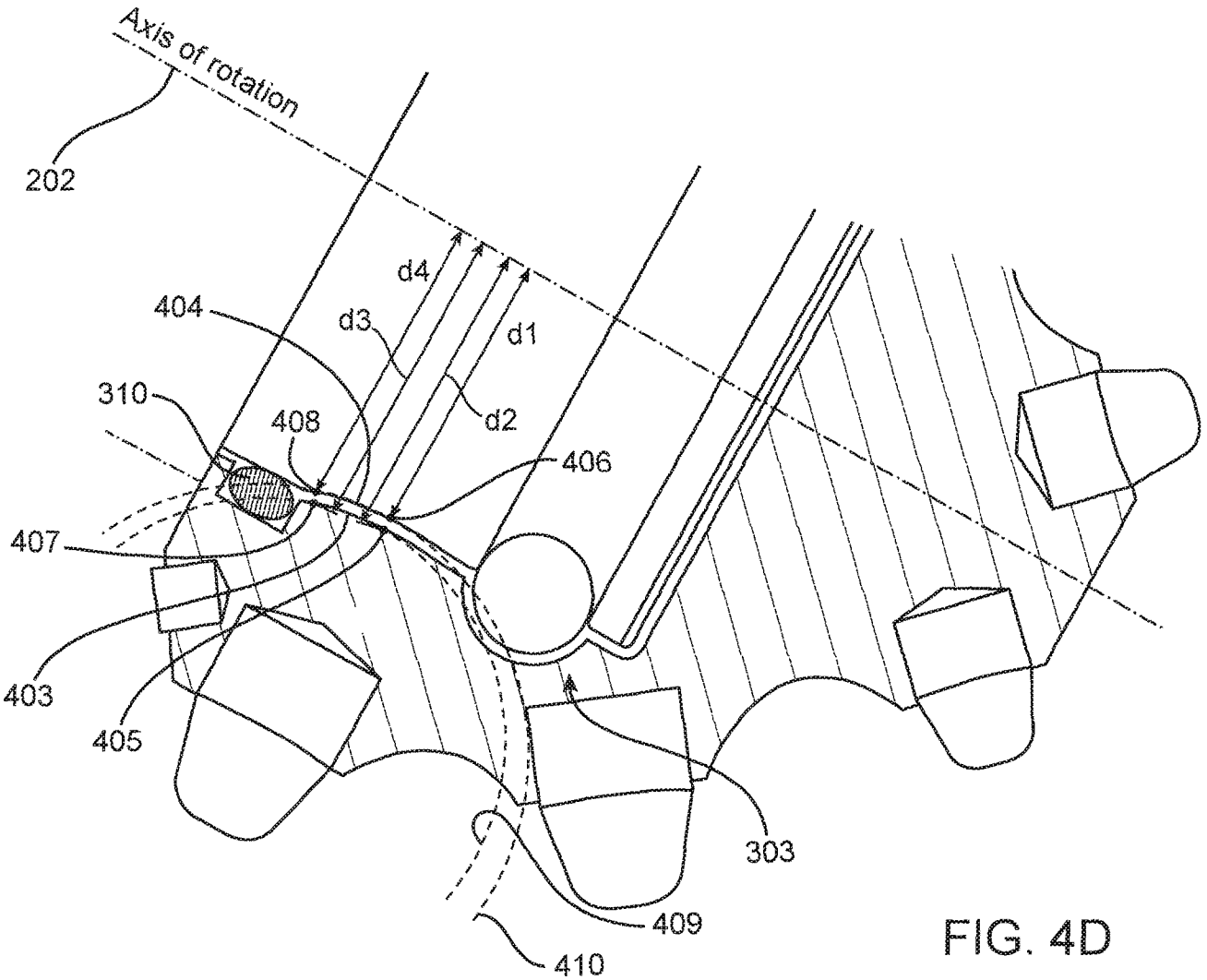
FIG. 4D is close up view of one section of the diagram shown in FIG. 4A.

The varying radius of the necked portions 404, 403 can be further illustrated with respect to distance from the rotational axis 202 as shown in in FIG. 4D. Starting at point 406 and extending toward point 408 at or near the seal 310, the necked portion 404 can have a curve which curves radially away from the rotational axis such that the radius of the necked portion 404 with respect to the rotational axis increases as the necked portion 404 approaches the seal 310. Accordingly, the radius d1 at point 406 increases to greater radius d4 at point 408 at or near seal 310. Correspondingly, the necked portion 403 of inner bearing surface 305, starting at 405, has a curve that curves radially away from the rotational axis, such that the radius of the necked portion 403 increases as the necked portion 403 approaches the seal 310 with respect to the rotational axis. Accordingly, the radius d2 at point 405 increases to a greater radius d3 at point 407 at or near seal 310.

Furthermore, the increase of radius from d2 to d3 occurs at a greater rate than the increase of radius from d1 to d4, thus causing the radius of curvature in a plane through the rotation axis 202 of the necked portions 403, 404 to differ.

As previously discussed, such radius of curvature of the necked portion 404 is greater than that of necked portion 403.

Referring back to FIGS. 4A and 4B, contiguous with the necked portion 404 of the outer bearing surface 306 of the shaft 302 is a cylindrical portion 402, which is positioned between the point 406 and the retention mechanism 303. Correspondingly, the inner bearing surface 305 has a cylindrical portion 401 which is positioned between the point 405 and the retention mechanism 303. Unlike the necked portions, the cylindrical portions 402 and 401 of the respective outer bearing surface 306 and inner bearing surface 305 have a substantially constant radius with respect to the rotational axis 202, and may be essentially parallel thereto.

Accordingly, the outer bearing surface 306 and inner bearing surface 305 extend from the retention mechanism 303 to the seal 310 first at a constant radius with respect to the rotational axis 202 at cylindrical portions 401, 402, but then transitions to a varying radius with respect to the rotational axis at the necked portions 403, 404. Moreover, the radius of the two surfaces differs, such that the radius of curvature through the rotational axis 202 of necked portion 403 is greater than that of necked portion 404. This varying radius and difference in the radius of curvature can cause a greater surface area of contact between the bearing surfaces, thereby spreading and alleviating the force imposed on such bearing surfaces during drilling.

One of ordinary skill in the art will appreciate that a similar effect can be achieved with curves different than those depicted in the figures and described herein. For example, only portions of surfaces 305 and 306 are depicted as curved, but one of ordinary skill in the art will understand the effect can be achieved with more or even all of surfaces 305 and 306 being curved. Nor are the examples limited to the direction of the curves as described and depicted. The curves can be arrange to increase in distance from the rotational axis while going toward or moving away from the seal end of the journal bearing.

Numerous examples are provided herein to enhance understanding of the present disclosure. A specific set of statements are provided as follows.

Statement 1: A drill bit assembly, including: a bearing shaft having an outer bearing surface and defining a rotational axis, the outer bearing surface including a necked portion having a varying radius with respect to the rotational axis; and a roller cone coupled about the bearing shaft and including an outer cutting structure and an inner bearing surface, the inner bearing surface including a necked portion proximate to and closely conforming to the necked portion of the outer bearing surface.

Statement 2: The drill bit assembly according to Statement 1, wherein the necked portion of the outer bearing surface has a first radius of curvature in a plane through the rotational axis and the necked portion of the inner bearing surface has a second radius of curvature in a plane through the rotational axis, wherein the first radius of curvature differs from the second radius of curvature.

Statement 3: The drill bit assembly according to Statement 2, wherein the first radius of curvature differs from the second radius of curvature by between 2% and 15%.

Statement 4: The drill bit assembly according to any of the Statements 1 to 3, wherein one or both of the outer bearing surface of the bearing shaft and the inner bearing surface of the roller cone further includes a cylindrical portion contiguous with the respective necked portion, the cylindrical portion having a substantially constant radius with respect to the rotational axis.

Statement 5: The drill bit assembly according to any of the Statements 2 to 4, wherein the first radius of curvature is larger than the second radius of curvature.

Statement 6: The drill bit assembly according to any of the Statements 1 to 5, wherein a seal is formed between the bearing shaft and roller cone at a first location of the bearing shaft, and a retention mechanism is formed between the bearing shaft and roller cone at a second location of the bearing shaft.

Statement 7: The drill bit assembly according to Statement 6, the necked portion of the outer bearing surface and the necked portion of the inner bearing surface being positioned between the seal and the retention mechanism.

Statement 8: The drill bit assembly according to Statement 6 or Statement 7, wherein the necked portion of the outer bearing surface has an increasing radius with respect to the rotational axis as the necked portion approaches the seal.

Statement 9: The drill bit assembly according to any of the Statements 6 to 8, wherein one or both of the outer bearing surface of the bearing shaft and the inner bearing surface of the roller cone further includes a cylindrical portion contiguous with the respective necked portion, the cylindrical portion having a substantially constant radius with respect to the rotational axis, and wherein the necked portion of the outer bearing surface cylindrical portion is closer to the seal than the cylindrical portion of the one or both of the outer bearing surface of the bearing shaft and the inner bearing surface of the roller cone.

Statement 10: The drill bit assembly according to Statement 1, wherein at least a portion of the outer bearing surface and a portion of the inner bearing surface cooperate to form a journal bearing.

Statement 11: A drill system including: a drill string provided in a wellbore, the drill string having a drill bit assembly provided on an end, the drill bit assembly having: a bearing shaft having an outer bearing surface and defining a rotational axis, the outer bearing surface including a necked portion having a varying radius with respect to the rotational axis; and a roller cone coupled about the bearing shaft and including an outer cutting structure and an inner bearing surface, the inner bearing surface including a necked portion proximate to and closely conforming to the necked portion of the outer bearing surface.

Statement 12: The drill system according to Statement 11, wherein the necked portion of the outer bearing surface has a first radius of curvature in a plane through the rotational axis and the necked portion of the inner bearing surface has a second radius of curvature in a plane through the rotational axis, wherein the first radius of curvature differs from the second radius of curvature.

Statement 13: The drill system according to Statement 12, wherein the first radius of curvature differs from the second radius of curvature by between 2% and 15%.

Statement 14: The drill system according to any of the Statements 11 to 13, wherein one or both of the outer bearing surface of the bearing shaft and the inner bearing surface of the roller cone further includes a cylindrical portion contiguous with the respective necked portion, the cylindrical portion having a substantially constant radius with respect to the rotational axis.

Statement 15: The drill system according to any of the Statements 12 to 14, wherein the second radius of curvature is less than the first radius of curvature.

Statement 16: The drill system according to any of the Statements 11 to 15, wherein a seal is formed between the bearing shaft and roller cone at a first location of the bearing shaft, and a retention mechanism is formed between the bearing shaft and roller cone at a second location of the bearing shaft.

Statement 17: The drill system according to Statement 16, the necked portion of the outer bearing surface and the necked portion of the inner bearing surface being positioned between the seal and the retention mechanism.

Statement 18: The drill system according to Statement 16 or Statement 17, wherein the necked portion of the outer bearing surface has an increasing radius with respect to the rotational axis as it extends toward the seal Statement 19: The drill system according to any of the Statements 16 to 18, wherein one or both of the outer bearing surface of the bearing shaft and the inner bearing surface of the roller cone further includes a cylindrical portion contiguous with the respective necked portion, the cylindrical portion having a substantially constant radius with respect to the rotational axis, and wherein the necked portion of the outer bearing surface cylindrical portion is closer to the seal than the cylindrical portion of the one or both of the outer bearing surface of the bearing shaft and the inner bearing surface of the roller cone.

Statement 20: The drill system according to any of the Statements 11 to 19, wherein at least a portion of the outer bearing surface and a portion of the inner bearing surface cooperate to form a journal bearing.

Statement 21: A method including drilling in a wellbore with a roller cone drill bit assembly, the rotary drill bit assembly including a bearing shaft having an outer bearing surface and defining a rotational axis, the outer bearing surface including a necked portion having a varying radius with respect to the rotational axis; and a roller cone coupled about the bearing shaft and including an outer cutting structure and an inner bearing surface, the inner bearing surface including a necked portion proximate to and closely conforming to the necked portion of the outer bearing surface.

In the above description, terms such as "lower," "downhole," and the like, when used in relation to orientation within a wellbore, shall mean in relation to the bottom or furthest extent of, the surrounding wellbore even though the wellbore or portions of it may be deviated or horizontal.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected.

The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The term "axially" means substantially along a direction of the axis of the object. If not specified, the term axially is such that it refers to the longer axis of the object.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A drill bit assembly, comprising:

a bearing shaft having an outer bearing surface and defining a rotational axis, the outer bearing surface including a necked portion having a varying radius with respect to the rotational axis; and a roller cone coupled about the bearing shaft and including an outer cutting structure and an inner bearing surface, the inner bearing surface including a necked portion proximate to and closely conforming to the necked portion of the outer bearing surface, wherein the necked portion of the outer bearing surface has a first radius of curvature in a plane through the rotational axis and the necked portion of the inner bearing surface has a second radius of curvature in a plane through the rotational axis, wherein the first radius of curvature differs from the second radius of curvature.

2. The drill bit assembly of claim 1, wherein the first radius of curvature differs from the second radius of curvature by between 2% and 15%.

3. The drill bit assembly of claim 1, wherein one or both of the outer bearing surface of the bearing shaft and the inner bearing surface of the roller cone further comprise a cylindrical portion contiguous with the respective necked portion, the cylindrical portion having a substantially constant radius with respect to the rotational axis.

4. The drill bit assembly of claim 3, wherein a seal is formed between the bearing shaft and roller cone at a first location of the bearing shaft, and a retention mechanism is formed between the bearing shaft and roller cone at a second location of the bearing shaft, and wherein the cylindrical portion is located between the seal and the retention mechanism.

5. The drill bit assembly of claim 1, wherein the first radius of curvature is larger than the second radius of curvature.

6. The drill bit assembly of claim 1, wherein a seal is formed between the bearing shaft and roller cone at a first location of the bearing shaft, and a retention mechanism is formed between the bearing shaft and roller cone at a second location of the bearing shaft.

7. The drill bit assembly of claim 6, the necked portion of the outer bearing surface and the necked portion of the inner bearing surface being positioned between the seal and the retention mechanism.

8. The drill bit assembly of claim 6, wherein the necked portion of the outer bearing surface has an increasing radius with respect to the rotational axis as the necked portion approaches the seal.

9. The drill bit assembly of claim 6, wherein one or both of the outer bearing surface of the bearing shaft and the inner bearing surface of the roller cone further comprise a cylindrical portion contiguous with the respective necked portion, the cylindrical portion having a substantially constant radius with respect to the rotational axis, and wherein the necked portion of the outer bearing surface is closer to the seal than the cylindrical portion of the one or both of the outer bearing surface of the bearing shaft and the inner bearing surface of the roller cone.

10. The drill bit assembly of claim 1, wherein at least a portion of the outer bearing surface and a portion of the inner bearing surface cooperate to form a journal bearing.

11. A drill system comprising:

a drill string provided in a wellbore, the drill string having a drill bit assembly provided on an end, the drill bit assembly having:

a bearing shaft having an outer bearing surface and defining a rotational axis, the outer bearing surface including a necked portion having a varying radius with respect to the rotational axis; and a roller cone coupled about the bearing shaft and including an outer cutting structure and an inner bearing surface, the inner bearing surface including a necked portion proximate to and closely conforming to the necked portion of the outer bearing surface, wherein the necked portion of the outer bearing surface has a first radius of curvature in a plane through the rotational axis and the necked portion of the inner bearing surface has a second radius of curvature in a plane through the rotational axis, wherein the first radius of curvature differs from the second radius of curvature.

12. The drill system of claim 11, wherein the first radius of curvature differs from the second radius of curvature by between 2% and 15%.

13. The drill system of claim 11, wherein one or both of the outer bearing surface of the bearing shaft and the inner bearing surface of the roller cone further comprise a cylindrical portion contiguous with the respective necked portion, the cylindrical portion having a substantially constant radius with respect to the rotational axis.

14. The drill system of claim 11, wherein the second radius of curvature is less than the first radius of curvature.

15. The drill system of claim 11, wherein a seal is formed between the bearing shaft and roller cone at a first location of the bearing shaft, and a retention mechanism is formed between the bearing shaft and roller cone at a second location of the bearing shaft.

16. The drill system of claim 15, the necked portion of the outer bearing surface and the necked portion of the inner bearing surface being positioned between the seal and the retention mechanism.

17. The drill system of claim 15, wherein the necked portion of the outer bearing surface has an increasing radius with respect to the rotational axis as the necked portion approaches the seal.

18. The drill system of claim 15, wherein one or both of the outer bearing surface of the bearing shaft and the inner bearing surface of the roller cone further comprise a cylindrical portion contiguous with the respective necked portion, the cylindrical portion having a substantially constant radius with respect to the rotational axis, and wherein the necked portion of the outer bearing surface is closer to the seal than the cylindrical portion of the one or both of the outer bearing surface of the bearing shaft and the inner bearing surface of the roller cone.

19. The drill bit system of claim 11, wherein at least a portion of the outer bearing surface and a portion of the inner bearing surface cooperate to form a journal bearing between the roller cone and the bearing shaft.

* * * * *